US007337634B2

(12) United States Patent
Buckroyd et al.

(10) Patent No.: US 7,337,634 B2
(45) Date of Patent: Mar. 4, 2008

(54) WASHER/DRYER TOUCH SENSITIVE GRAPHICAL USER INTERFACE

(75) Inventors: James David Buckroyd, Louisville, KY (US); Richard Anthony Smith, Louisville, KY (US)

(73) Assignee: General Electric Company, Schenectady, NY (US)

( * ) Notice: Subject to any disclaimer, the term of this patent is extended or adjusted under 35 U.S.C. 154(b) by 595 days.

(21) Appl. No.: 10/248,322

(22) Filed: Jan. 9, 2003

(65) Prior Publication Data

US 2004/0134238 A1 Jul. 15, 2004

(51) Int. Cl.
*D06F 33/00* (2006.01)

(52) U.S. Cl. ..... 68/12.23; 68/12.27

(58) Field of Classification Search ..... 68/12.27, 68/12.12, 12.23
See application file for complete search history.

(56) References Cited

U.S. PATENT DOCUMENTS 4,763,493 A * 8/1988 Nishite et al. ..... 68/12.27
4,977,394 A * 12/1990 Manson et al. ..... 340/679
5,279,134 A 1/1994 Nonogacki et al.
5,694,793 A 12/1997 Nishimura et al.
6,029,298 A 2/2000 Dausch et al.
6,502,265 B2 * 1/2003 Blair et al. ..... 8/159
6,523,205 B1 * 2/2003 Broker et al. ..... 8/158
6,629,439 B2 * 10/2003 Wobkemeier ..... 68/12.02
6,671,916 B2 * 1/2004 Herr et al. ..... 8/159
6,934,592 B2 * 8/2005 Hood et al. ..... 700/83
2001/0042391 A1 * 11/2001 Wobkemeier ..... 68/12.02
2002/0078511 A1 6/2002 Blair et al.

* cited by examiner

*Primary Examiner*—Joseph L. Perrin
(74) *Attorney, Agent, or Firm*—George L. Rideout, Esq.; Armstrong Teasdale LLP

(57) ABSTRACT

A control interface for a laundry appliance includes a microcomputer and a reconfigurable display coupled to the microcomputer. The microcomputer is programmed to present at least one input screen on the reconfigurable display for user selection of laundry cycle parameters.

14 Claims, 8 Drawing Sheets

WASHER/DRYER TOUCH SENSITIVE GRAPHICAL USER INTERFACE

BACKGROUND OF INVENTION

This invention relates generally to control systems for appliances, and more specifically, to interactive control displays for clothes washers and dryers.

Laundry appliances (e.g., clothes washers and dryers) typically include a number of mechanical components housed in a cabinet to perform different aspects of clothes washing and clothes drying. See, for example, U.S. Pat. No. 6,029,298 describing a washing machine.

Conventionally, mechanical switches and actuators have been employed for user manipulation thereof to operate a clothes washer or dryer in selected settings and to activate or deactivate appliance features and options. Known electronic controls, however, have facilitated washer and dryer features and modes of operation not found in conventional mechanically controlled systems. For example, an increased number of washing cycles and associated options are now available in washing machines, and various drying cycles and features have also been developed to increase appliance performance and convenience. Known control interfaces to implement these features, however, tend to be cumbersome and difficult to new users, and tedious and time consuming for other users. Some washer and dryer operations and features require rather complex manipulation of a control interface that includes a large number of selectors for a large number of washing options, which can be overwhelming to new users and less than intuitive even to experienced users. Significant cognitive effort is therefore required to operate these machines.

SUMMARY OF INVENTION

In one aspect, a control interface for a laundry appliance is provided. The control interface comprises a microcomputer and a reconfigurable display coupled to said microcomputer. The microcomputer is programmed to present at least one input screen on said reconfigurable display for user selection of laundry cycle parameters.

In another aspect, a control interface for a laundry appliance is provided. The control interface comprises a microcomputer and a touch sensitive reconfigurable display coupled to said microcomputer. The microcomputer programmed to present a plurality of laundry cycle input screens to a user for selection of laundry cycle parameters, and at least one of said plurality of displays comprises a graphical icon.

In another aspect, a laundry appliance is provided. The appliance comprises a cabinet, a laundry article container rotatably mounted within said cabinet, a drive system for rotating said laundry article container, and at least one microcomputer operatively coupled to said drive system for laundry cycle control thereof according to user input of laundry cycle parameters. A reconfigurable display is operatively coupled to and in communication with said at least one microprocessor, and the reconfigurable display is configured to receive user input and adjustment of said laundry cycle parameters through a plurality of selection screens.

In another aspect, a method of operating a laundry appliance is provided. The laundry appliance includes a reconfigurable display and a microcomputer coupled thereto, and the microcomputer is programmed to generate a plurality of laundry cycle parameter input screens. The method comprises presenting a first laundry cycle parameter input screen on said display, and based upon user response to the first input screen, presenting a second laundry cycle parameter input screen on said display, said second laundry cycle input screen different form said first laundry cycle input screen.

In still another aspect, a method of operating a laundry appliance is provided. The appliance includes a touch sensitive reconfigurable display and a microcomputer coupled thereto, and the microcomputer is programmed to generate a plurality of laundry cycle parameter input screens on said display. The method comprises receiving user input of laundry cycle parameters through the touch sensitive reconfigurable display; once user input is received, displaying a summary screen on the reconfigurable display indicating selected laundry cycle settings and options received; and accepting further input through the touch sensitive screen when the summary screen is displayed, thereby allowing the selected laundry cycle settings and options to be changed.

DETAILED DESCRIPTION

Figure 1:
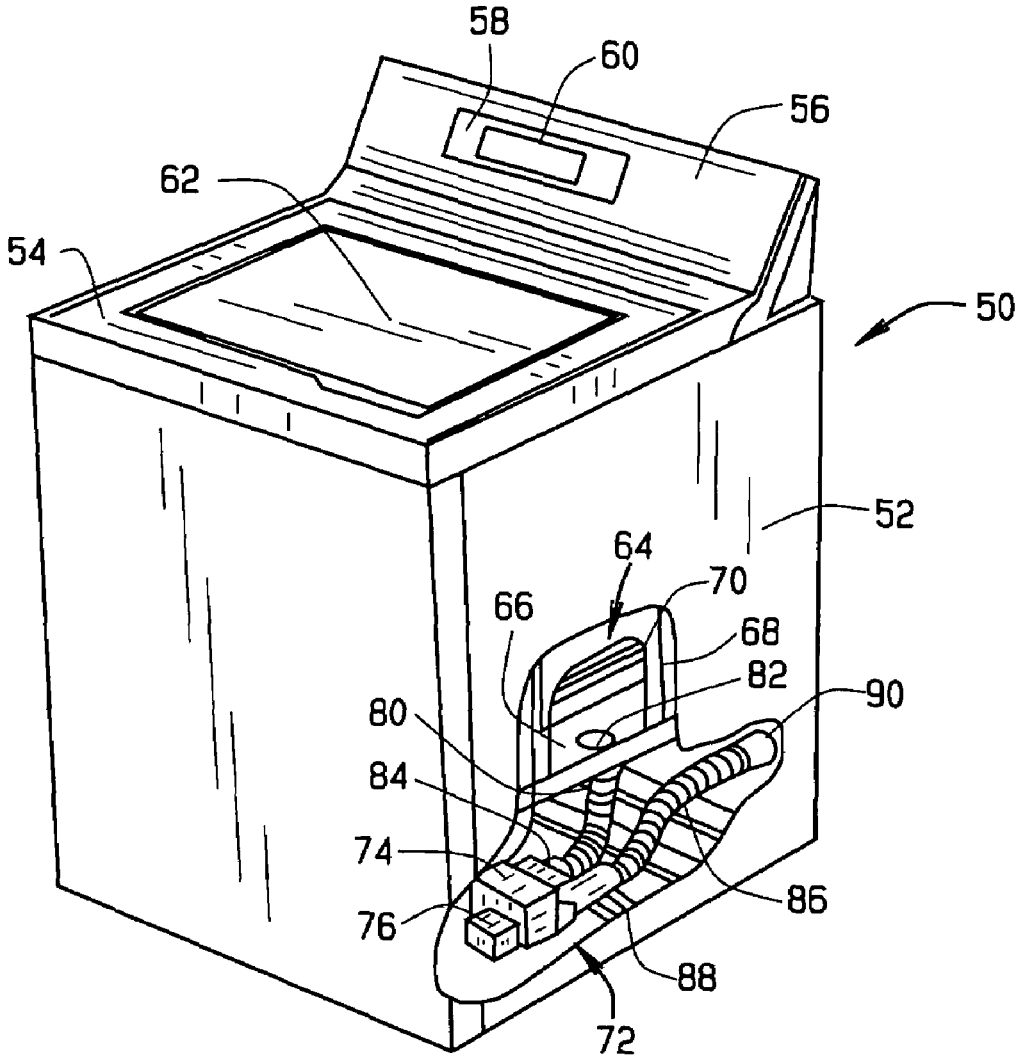
FIG. 1 is a perspective cutaway view of an exemplary washing machine appliance.

FIG. 1 is a perspective view partially broken away of an exemplary laundry appliance 10 in which the present invention may be practiced. While laundry appliance 10 in the illustrated embodiment is a washing machine, the control principles and associated advantages described below are equally applicable to other types of laundry appliances, including but not limited to other types of washing machines and clothes dryer machines. Therefore, the illustrated washing machine 10 is offered for illustrative purposes only and in no way is intended to limit the invention in any aspect.

Exemplary washing machine 10 includes a cabinet 52 and a cover 54. A backsplash 56 extends from cover 54, and a control interface 58 including at least one display 60 is coupled to backsplash 56. Control interface 58 and display 60 collectively form a user interface input for operator selection of machine cycles and features.

A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64. As illustrated in FIG. 1, machine 10 is a vertical axis washing machine. It is contemplated however, that the benefits of the present invention are equally applicable to other types of washing machines, such as horizontal axis machines familiar to those in the art.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74, a motor 76, and in an exemplary embodiment a motor fan (not shown). A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

In an exemplary embodiment, control interface display 60 is reconfigurable to produce a variety of different user friendly display screens to guide a washing machine user through a wash cycle selection, as explained below. As used herein, display screen 60 is deemed reconfigurable in that it does not have a fixed configuration capable of displaying only a limited number of messages or indicators in designated locations in display 60, but rather is capable of generating a large variety of symbols, alphanumeric characters, and indicia within the confines of display 60 to produce a given screen display. As will be seen below, display 60, together with a microcomputer coupled thereto, generates intuitive graphical displays including text and icons in a readily understandable form for intuitive operation of machine 50.

Thus, unlike known light emitting diode (LED) and certain liquid crystal displays (LCD"s) operable to display a limited number of preset indicators in predetermined locations, display 60 is capable of displaying different displays including messages and symbols of varying length and size at selected locations in display 60. In other words, display 60 is a graphic display screen capable of regenerating multiple and different text and symbol displays. Display screens capable of such image generation are known and include liquid crystal display (LCD), cathode ray tube (CRT), a plasma display, or the like which employ fragmented image generation, such as with pixels. Also in an exemplary embodiment, display 60 is a known touch sensitive display to allow user selection of washing machine features by touching activated regions of display 60.

While the illustrated embodiment includes one reconfigurable display 60, it is recognized that in alternative embodiments more than one reconfigurable display could be employed in control interface 58 for selection of different wash cycle features. Further, one or more mechanical input selector or other fixed electronic input selector (i.e., not reconfigurable as described above) may be employed in combination with display 60 for user selection of machine features.

Figure 2:
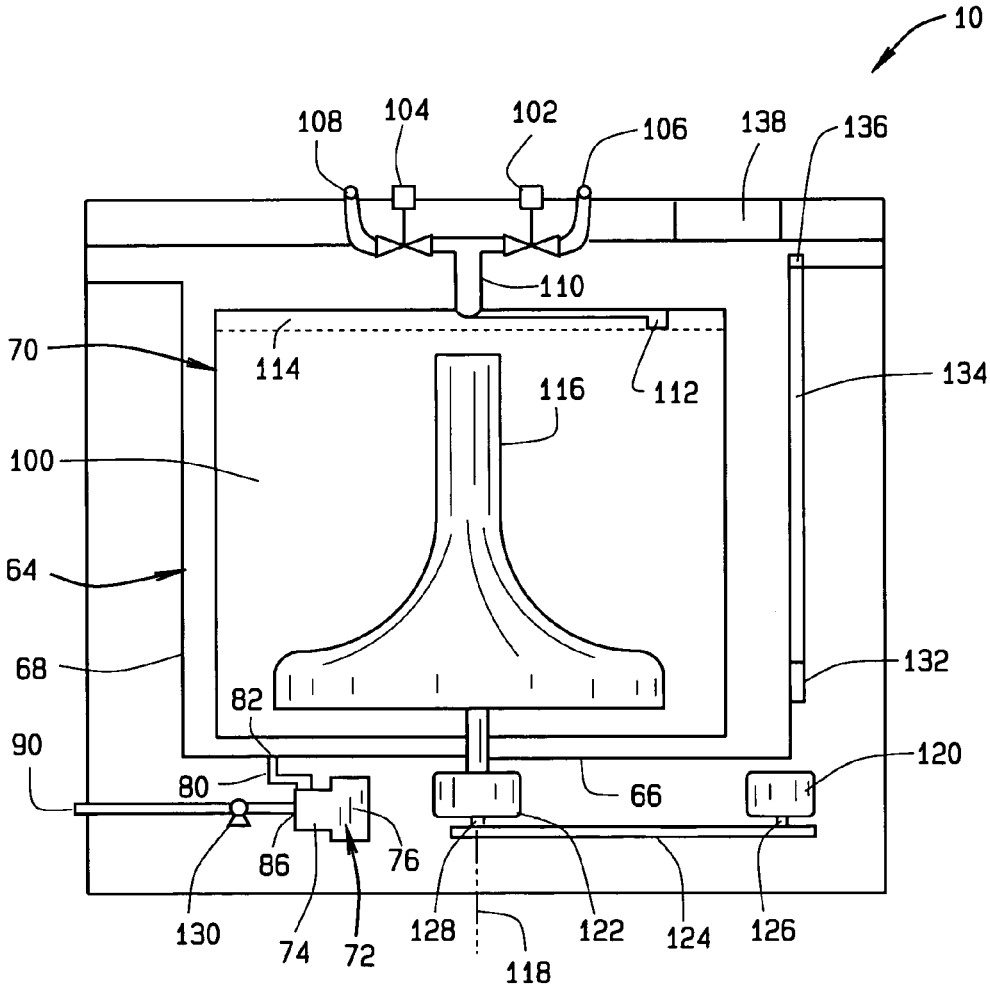
FIG. 2 is front elevational schematic view of the washing machine shown in FIG. 1.

FIG. 2 is a front elevational schematic view of washing machine 10 including wash basket 70 movably disposed and rotatably mounted in wash tub 64 in a spaced apart relationship from tub side wall 64 and tub bottom 66. Basket 12 includes a plurality of perforations therein to facilitate fluid communication between an interior 100 of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine 10 and, when connected to a building plumbing system (not shown), provide a fresh water supply for use in washing machine 10. Liquid valves 102, 104 and liquid hoses 106, 108 are connected to a basket inlet tube 110, and fluid is dispersed from inlet tube 110 through a known nozzle assembly 112 having a number of openings therein to direct washing liquid into basket 70 at a given trajectory and velocity. A known dispenser (not shown in FIG. 2), may also be provided to produce a wash solution by mixing fresh water with a known detergent or other composition for cleansing or articles in basket 70.

In an alternative embodiment, a known spray fill conduit 114 (shown in phantom in FIG. 2) may be employed in lieu of nozzle assembly 112. Along the length of the spray fill conduit 114 are a plurality of openings arranged in a predetermined pattern to direct incoming streams of water in a downward tangential manner towards articles in basket. The openings in spray fill conduit 114 are located a predetermined distance apart from one another to produce an overlapping coverage of liquid streams into basket 70. Articles in basket 70 may therefore be uniformly wetted even when basket 70 is maintained in a stationary position.

A known agitator, impeller, or oscillatory basket mechanism 116 is disposed in basket 70 to impart an oscillatory motion to articles and liquid in basket 70. As illustrated in FIG. 2, agitator 116 is oriented to rotate about a vertical axis 118. It is contemplated, however, that at least some of the benefits of the present invention may apply to horizontal axis washing machines as well.

Basket 70 and agitator 116 are driven by motor 120 through a transmission and clutch system 122. A transmission belt 124 is coupled to respective pulleys of a motor output shaft 126 and a transmission input shaft 128. Thus, as motor output shaft 126 is rotated, transmission input shaft 128 is also rotated. Clutch system 122 facilitates driving engagement of basket 70 and agitator 116 for rotatable movement within wash tub 64, and clutch system 122 facilitates relative rotation of basket 70 and agitator 116 for selected portions of wash cycles Motor 120, transmission and clutch system 122 and belt 124 collectively are referred herein as a machine drive system.

Washing machine 10 also includes a brake assembly (not shown) selectively applied or released for respectively maintaining basket 70 in a stationary position within tub 64 or for allowing basket 70 to spin within tub 64. Pump assembly 72 is selectively activated to remove liquid from basket 70 and tub 64 through drain outlet 90 and a drain valve 130 during appropriate points in washing cycles as machine 10 is used. In an exemplary embodiment, machine 10 also includes a reservoir 132, a tube 134 and a pressure sensor 136. As fluid levels rise in wash tub 64, air is trapped in reservoir 132 creating a pressure in tube 134 that pressure sensor 136 monitors. Liquid levels, and more specifically, changes in liquid levels in wash tub 64 may therefore be sensed, for example, to indicate laundry loads and to facilitate associated control decisions. In further and alternative embodiments, load size and cycle effectiveness may be determined or evaluated using other known indicia, such as motor spin, torque, load weight, motor current, voltage or current phase shifts, etc.

Operation of machine 10 is controlled by a controller 138 which is operatively coupled to control interface 58 (shown in FIG. 1) located on washing machine backsplash 56 (shown in FIG. 1) for user manipulation to select washing machine cycles and features. In response to user manipulation of control interface 58, and more specifically display 60, controller 138 operates the various components of machine 10 to execute selected machine cycles and features.

In an illustrative embodiment, clothes are loaded into basket 70, and washing operation is initiated through operator manipulation of reconfigurable display 60 (shown in FIG. 1). Tub 64 is filled with water and mixed with detergent to form a wash fluid, and basket 70 is agitated with agitator 116 for cleansing of clothes in basket 70. After a predetermined period of agitation, tub 64 is drained with pump assembly 72.

Figure 3:
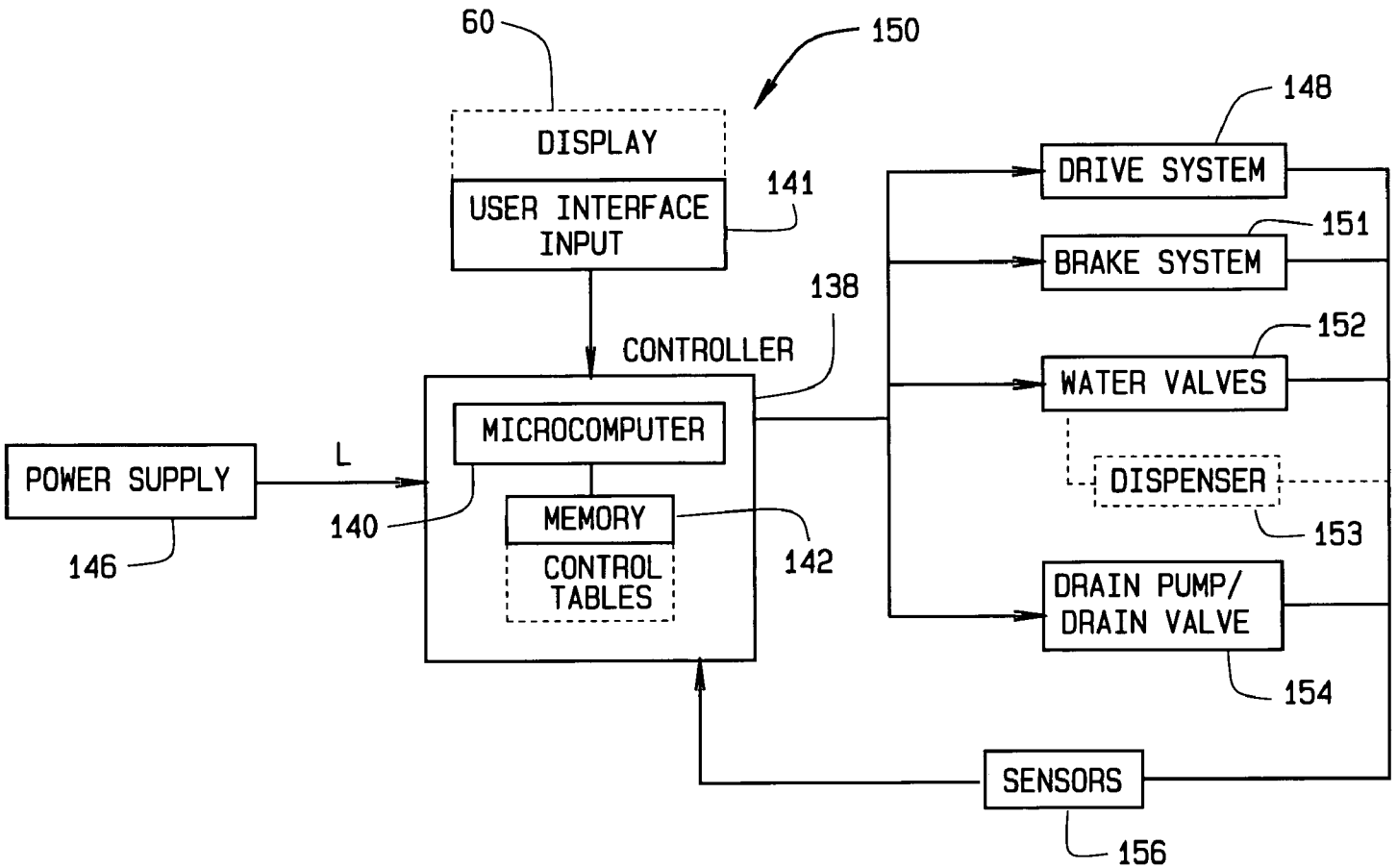
FIG. 3 is a schematic block diagram of a control system for the washing machine shown in FIGS. 1 and 2.

FIG. 3 is a schematic block diagram of an exemplary washing machine control system 150 for use with washing machine 10 (shown in FIGS. 1 and 2). Control system 150 includes controller 138 which may, for example, be a microcomputer 140 coupled to a user interface input 141, which includes control interface 58 (shown in FIG. 1) and display 60 (shown in FIG. 1). An operator may enter instructions or select desired washing machine cycles and features via user interface input 141, such as through display 60, as explained below. A memory 142 is also coupled to microcomputer 140 and stores instructions, calibration constants, and other information as required to satisfactorily complete a selected wash cycle. Memory 142 may, for example, be a random access memory (RAM). In alternative embodiments, other forms of memory could be used in conjunction with RAM memory, including but not limited to electronically erasable programmable read only memory (EEPROM).

Power to control system 150 is supplied to controller 138 by a power supply 146 configured to be coupled to a power line L. Analog to digital and digital to analog converters (not shown) are coupled to controller 138 to implement controller inputs and executable instructions to generate controller output to washing machine components such as those described above in relation to FIGS. 1 and 2. More specifically, controller 138 is operatively coupled to machine drive system 148 (e.g., motor 120 and clutch system 122 shown in FIG. 2), a brake assembly 151 associated with basket 70 (shown in FIG. 2), machine water valves 152 (e.g., valves 102, 104 shown in FIG. 2) and machine drain system 154 (e.g., drain pump assembly 72 and/or drain valve 130 shown in FIG. 2) according to known methods. In a further embodiment, water valves 152 are in flow communication with a dispenser 153 (shown in phantom in FIG. 3) so that water may be mixed with detergent or other composition of benefit to washing of garments in wash basket 70 (shown in FIG. 1).

In response to manipulation of user interface input 141 controller 138 monitors various operational factors of washing machine 10 with one or more sensors or transducers 156, and controller 138 executes operator selected functions and features according to known methods. Of course, controller 138 may be used to control washing machine system elements and to execute functions beyond those specifically described herein.

Figure 4:
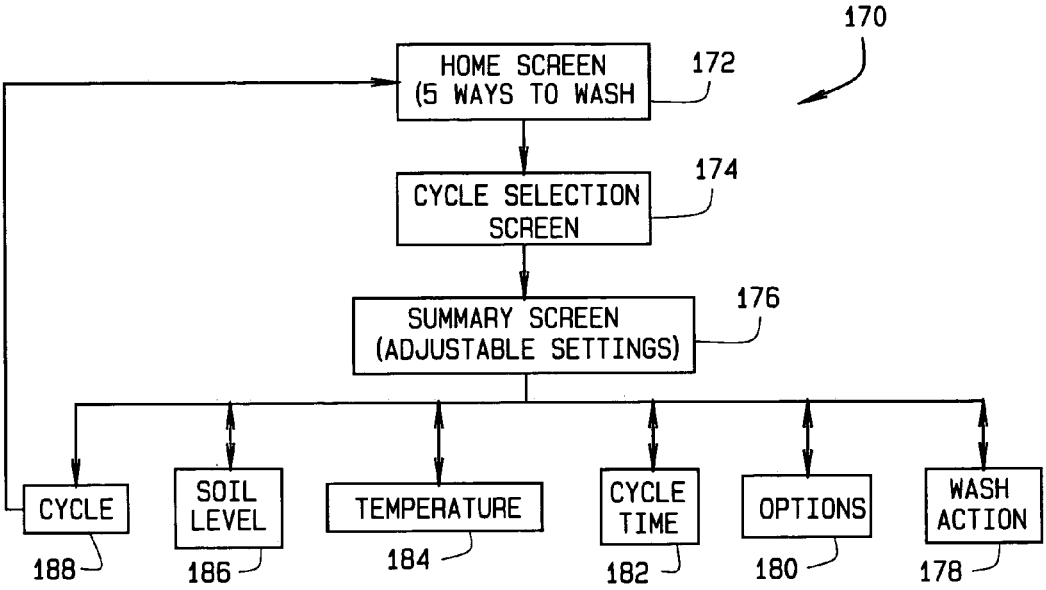
FIG. 4 is a schematic diagram of a task flow user input system for the control system shown in FIG. 3.

FIG. 4 is a schematic diagram of a task flow user input system 170 executable by control system 150 (shown in FIG. 3) and including a plurality of task-oriented screen displays to be generated on display 60 (shown in FIGS. 1 and 3) through microcomputer 140 (shown in FIG. 3) and associated memory structure. By touching appropriate regions of display 60 to select desired features using the screen displays, a user may be efficiently guided through wash cycle selection and machine operation in a simple and direct manner with reduced cognitive effort in comparison to known washing machine control schemes. Control decisions may be made in an organized, intuitive fashion with graphic displays presented in a designated sequence. Thus, a user may be directed to make control decision inputs in a step-by-step process with a limited number of selection inputs at each screen. Thus, a complicated and overwhelming control interface with a large number of input selectors presented simultaneously to a user as in known systems is avoided, and a user friendly system capable of accommodating expanded washing machine features is provided.

In an illustrative embodiment, task flow user input system 170 includes a HOME screen 172 wherein a basic cycle type determination is to be made, a CYCLE SELECTION screen 174 including further control inputs corresponding the selection made from HOME screen 172, and a SUMMARY screen 176 wherein a user may observe selected cycle characteristics. From the SUMMARY screen 176, a user may access additional input screens to adjust or customize a wash cycle. In an exemplary embodiment, the additional input screens include a WASH ACTION screen 178, an OPTIONS screen 180, a CYCLE TIME screen 182, a TEMPERATURE screen 184, and a SOIL LEVEL screen 186.

The benefits and advantages of task flow user input system 170 will now be demonstrated with respect to exemplary screens 172, 174, 176, 178, 180, 182, 184, and 186 discussed below.

Figure 5:
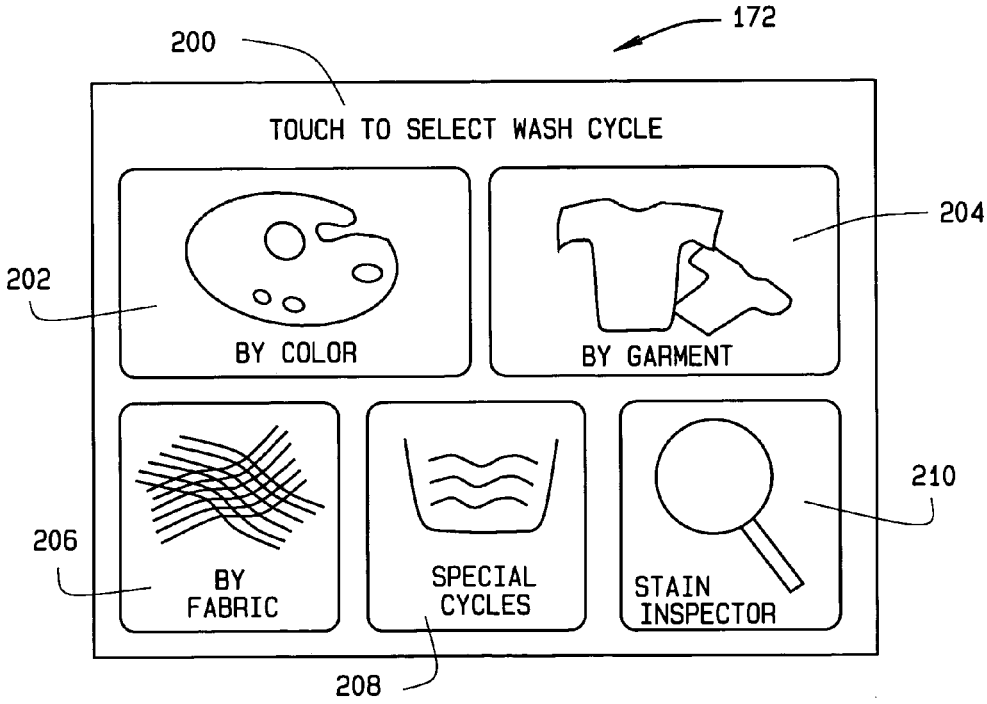
FIG. 5 is a home screen display for the system shown in FIG. 4.

FIG. 5 is an exemplary HOME screen display 172 for task flow user input system 170 (shown in FIG. 4). HOME screen 172 includes a title message 200 and five basic regions for wash cycle type determination. Specifically, and in an illustrative embodiment, the selection regions include a COLOR region 202, a GARMENT region 204, a FABRIC region 206, a SPECIAL CYCLE region 208, and a STAIN INSPECTOR region 210. Thus, when HOME screen display 172 is presented to a user on display 60 (shown in FIGS. 1 and 3), a user may select one of regions 202, 204, 206, 208 and 210 to select a wash cycle by color, by garment, by fabric, by special needs, or by stain characteristics of clothes and garments. While the illustrated embodiment of HOME screen 172 includes five cycle type regions 200-210, it is recognized that greater or fewer than five cycle-type regions could be employed in alternative embodiments without departing from the scope of the present invention. Moreover, it is contemplated that one of regions 200-210 may correspond to a second HOME screen with more cycle type choices.

To assist in the selection process, each respective region 202-210 includes a title and a graphical icon. Thus, as illustrated in FIG. 5, COLOR region 202 includes a color palette icon, GARMENT region 204 includes T-shirt icons, FABRIC region 206 includes a threaded fiber icon, SPECIAL CYCLE region 208 includes a cup icon, and STAIN INSPECTOR region 210 includes a magnifying glass. The icons are large and prominently displayed so that a cycle type selection may generally be made without inspection of the region titles. Each region 202-210 is associated with a different CYCLE SELECTION screen 174 (shown in FIG. 4), and by touching one of desired regions 202-210 to select the associated wash cycle type, microcomputer 140 (shown in FIG. 3) generates the respective CYCLE SELECTION screen 174 (shown in FIG. 4) for further wash cycle selection.

Figure 6:
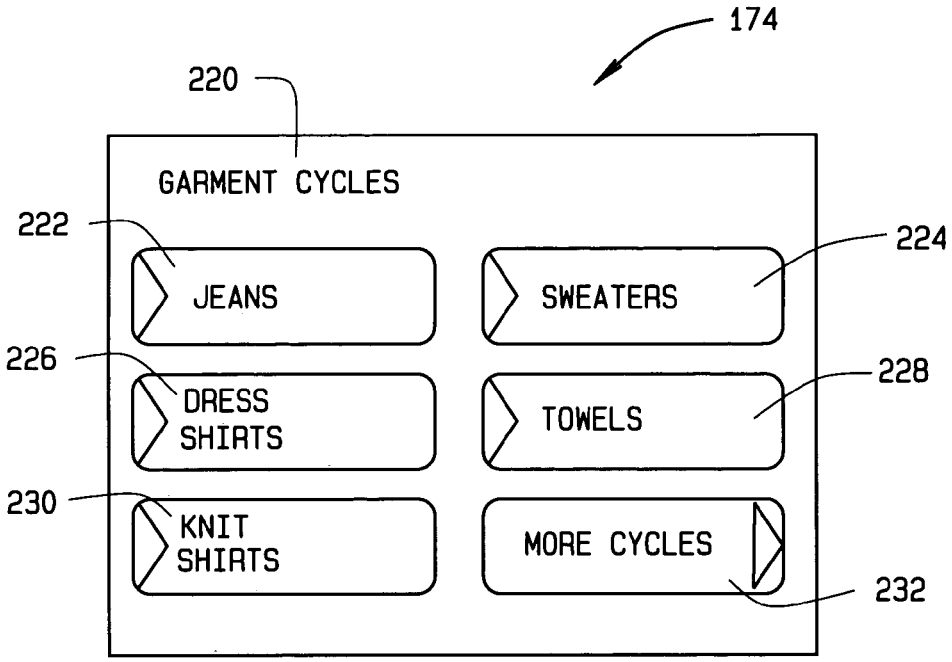
FIG. 6 is a wash cycle selection screen display for the system shown in FIG. 4.

FIG. 6 is an exemplary CYCLE SELECTION screen display 174 for system 170 (shown in FIG. 4). As illustrated in FIG. 6, CYCLE SELECTION screen 174 is a GARMENT CYCLE SELECTION screen that is displayed in response to user selection of GARMENT region 204 (shown in FIG. 5).

The illustrated GARMENT CYCLE SELECTION screen 174 includes a title message 220 and six basic regions for garment cycle determination. Specifically, and in an illustrative embodiment, the selection regions of screen 174 include a JEANS region 222, a SWEATERS region 224, a DRESS SHIRTS region 226, a TOWELS region 228, a KNIT SHIRTS region 230, and a MORE CYCLES region 232 for accessing another selection screen with additional garment types. Thus, when GARMENT CYCLE SELECTION screen display 174 is presented to a user on display 60 (shown in FIGS. 1 and 3), a user may select one of regions 222-232 to select a garment cycle for particular garments. While the illustrated embodiment of GARMENT CYCLE SELECTION screen 174 includes six garment regions 222-232, it is recognized that greater or fewer than six garment regions could be employed in alternative embodiments without departing from the scope of the present invention.

While the exemplary GARMENT CYCLE SELECTION screen does not include graphical icons in each of the regions, 222-232, it is contemplated that graphical icons may be employed in screen 174 to further assist in garment cycle selection. By touching one of desired regions 222-232 to select the associated garment type, microcomputer 140 (shown in FIG. 3) generates a SUMMARY screen 176 (shown in FIG. 4) to display features of the selected cycle and to allow user adjustment thereof.

Figure 7:
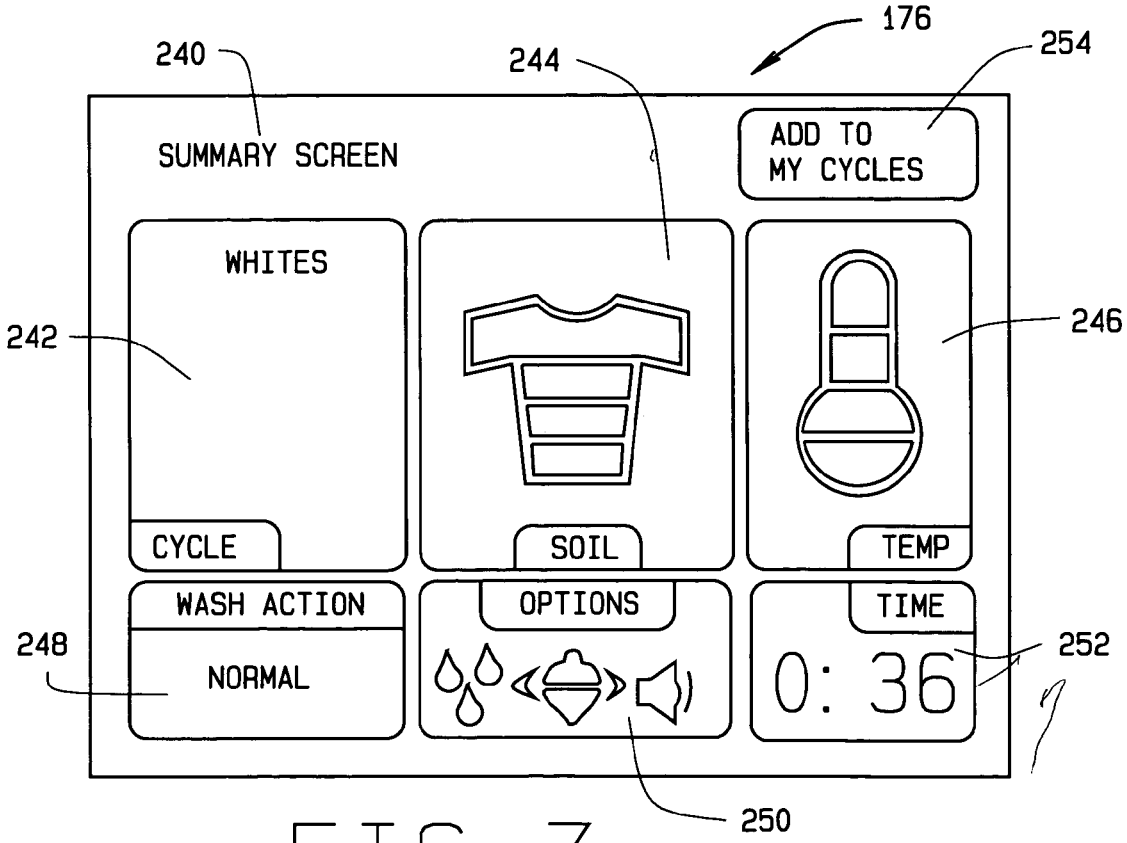
FIG. 7 is a wash cycle summary screen display for the system shown in FIG. 4.

FIG. 7 is an exemplary wash cycle SUMMARY screen display 176 for system 170 (shown in FIG. 4) that is displayed once the HOME screen 172 and CYCLE SELECTION SCREEN 174 have been presented to a user and selections have been made.

In an exemplary embodiment, SUMMARY screen 176 includes a title message 240 and six basic regions for adjustment of a selected wash cycle or for activation of optional features. Specifically, and in an illustrative embodiment, a CYCLE legend 242 is provided, and the selection regions include, a SOIL region 244, a TEMPERATURE region 246, a WASH ACTION region 248, an OPTIONS region 250, a TIME Region 252 and an ADD TO MY CYCLES region 254.

CYCLE region 242 displays the selected wash cycle type and the selected wash cycle. Thus, it may be deduced from FIG. 7 that the cycle selected from HOME screen 172 cycle by color, and that the color white was selected from CYCLE SELECTION screen 174.

Regions 244-252 display summary information pertaining to the particular cycle selected. The region titles and icons are large and prominently displayed so that washing characteristics and times may be readily confirmed and, if necessary, corrected. Thus, as seen in FIG. 7, SOIL region 244 includes a graphical T-shirt icon with four segments, two of which are filled in to indicate a soil setting of two out of four settings. TEMPERATURE region 246 includes a graphical thermometer icon including four segments, two of which are filled in to indicate a temperature setting of three out of five settings. WASH ACTION region 248 indicates a normal setting. OPTIONS region 250 includes a number of icons to indicate selected options explained below. TIME region 252 indicates a wash cycle timer that counts down to the end of a wash cycle. When a wash cycle is selected with CYCLE SELECTION screen 174, regions 244-252 indicate preset settings for the particular cycle selected, and when one of regions 244-252 are activated by a user, another screen is generated that allows user adjustment, activation or deactivation of cycle features. Thus, customized washing cycles may be created by a user, and ADD TO MY CYCLES Region allows a given wash cycle to be saved in memory by microcomputer 140 (shown in FIG. 3) for future recall.

Thus, when SUMMARY screen display 176 is presented to a user on display 60 (shown in FIGS. 1 and 3), a user may select one of regions 244-254 to select another screen associated with the particular region selected. While the illustrated embodiment of SUMMARY screen 176 includes seven regions 244-254, it is recognized that greater or fewer than seven regions could be employed in alternative embodiments without departing from the scope of the present invention. Moreover, it is contemplated that one of regions 244-254 may correspond to a second SUMMARY screen with more options and choices.

Figure 8:
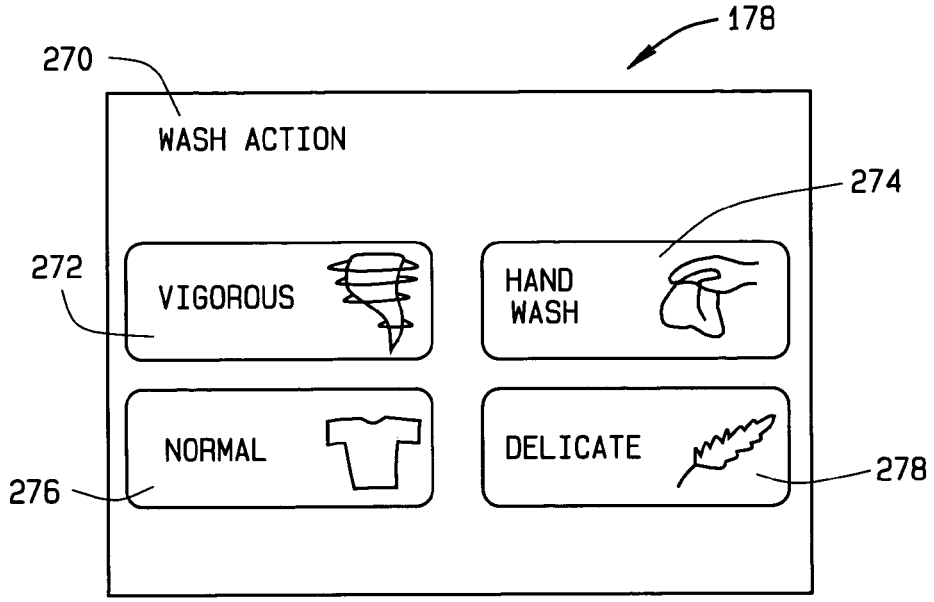
FIG. 8 is a wash action screen display for the system shown in FIG. 4.

FIG. 8 is an exemplary WASH ACTION screen display 178 generated by microcomputer 140 (shown in FIG. 3) in response to user activation of WASH ACTION region 248 (shown in FIG. 7) of SUMMARY SCREEN 176 (shown in FIG. 7).

WASH ACTION screen 178 includes a title message 270 and four regions for wash action selection. Specifically, and in an illustrative embodiment, the selection regions include a VIGOROUS region 272, a HAND WASH region 274, a NORMAL region 276, and a DELICATE region 278. Thus, when WASH ACTION screen display 178 is presented to a user on display 60 (shown in FIGS. 1 and 3), a user may select one of regions 272-278 to select a desired intensity of the wash cycle. While the illustrated embodiment of WASH ACTION screen 178 includes four wash action regions 272-278, it is recognized that greater or fewer intensity regions could be employed in alternative embodiments without departing from the scope of the present invention. Moreover, it is contemplated that one of regions 272-278 may correspond to a second WASH ACTION screen with additional wash action choices.

To assist in the selection process, each respective region 272-278 includes a title and a graphical icon. Thus, as illustrated in FIG. 8, VIGOROUS region 272 includes a tornado icon, HAND WASH region 274 includes a hand wash icon, NORMAL region 276 includes a T-shirt icon, and DELICATE region 278 includes a feather icon. The icons are large and prominently displayed so that a wash action setting may be made at a glance. Depressing one of regions 272-278 causes microcomputer 140 to display SUMMARY screen 176 (shown in FIG. 7) with the chosen wash action setting displayed in SUMMARY screen region 248 (shown in FIG. 7).

Figure 9:
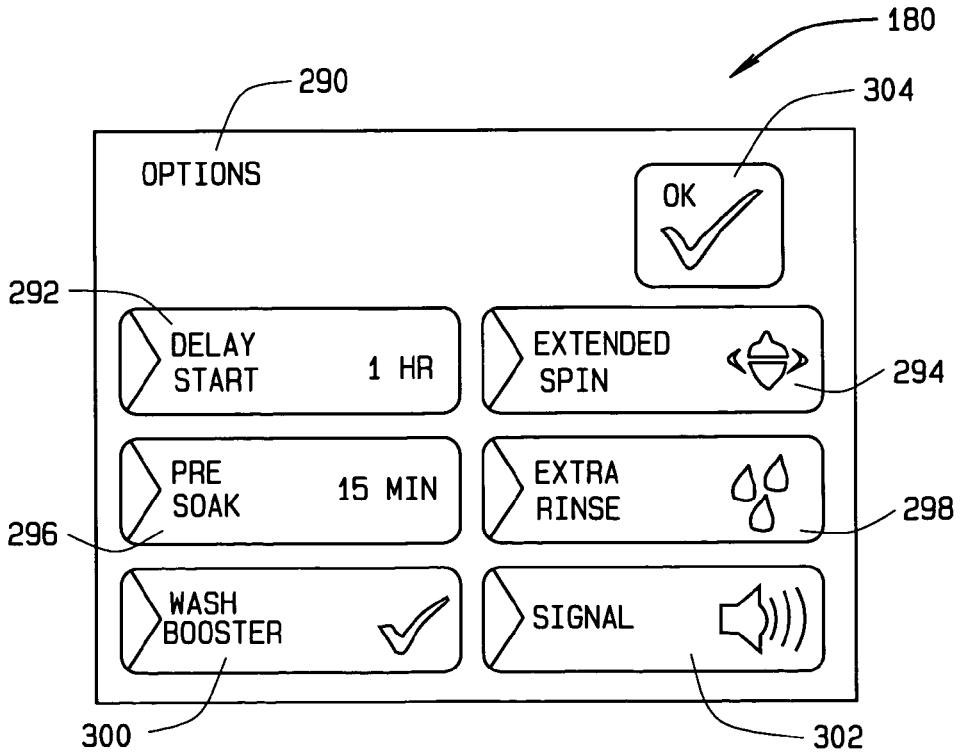
FIG. 9 is an options screen display for the system shown in FIG. 4.

FIG. 9 is an OPTIONS screen display 180 generated by microcomputer 140 (shown in FIG. 3) in response to user activation of OPTIONS region 250 (shown in FIG. 7) of SUMMARY SCREEN 176 (shown in FIG. 7).

OPTIONS screen 180 includes a title message 290 and seven regions for wash cycle options selection. Specifically, and in an illustrative embodiment, the selection regions include a DELAY START region 292, an EXTENDED SPIN region 294, a PRE-SOAK region 296, an EXTRA rinse region 298, and a WASH BOOSTER region 300, a SIGNAL region 302, and an OK region 304. Thus, when OPTIONS screen display 180 is presented to a user on display 60 (shown in FIGS. 1 and 3), a user may select one of regions 292-304 to select desired wash cycle options. While the illustrated embodiment of OPTIONS screen 180 includes seven regions 292-304, it is recognized that greater or fewer regions for wash cycle options could be employed in alternative embodiments without departing from the scope of the present invention. Moreover, it is contemplated that one of regions 292-304 may correspond to a second OPTIONS screen with additional wash option choices.

To assist in the selection process, each respective region 292-304 includes a title and a graphical icon. Thus, as illustrated in FIG. 9, DELAY START region 292 includes a time delay icon (e.g., 1 HR) to indicate the timed start delay, EXTENDED SPIN region 294 includes a spinning top icon, PRE-SOAK region 296 includes a time indicator for pre-soaking operations, EXTRA RINSE region 298 includes a raindrop icons, WASH BOOSTER region 300 includes a check mark icon to indicate that a wash booster feature has been selected, SIGNAL region 302 includes a loudspeaker icon to indicate an audio alarm when the wash cycle is completed, and OK region 304 includes a checkmark icon. The icons are large and prominently displayed so that options may be selected at a glance. Depressing one of regions 292-304 causes microcomputer 140 to activate a desired option, and when all desired options are selected, the user activates OK region 304. When OK region 304 is activated, microcomputer 140 displays SUMMARY screen 176 (shown in FIG. 7) with the chosen option icons displayed in SUMMARY screen region 250 (shown in FIG. 7).

In further embodiments, depressing or activation of DELAY START and PRE-SOAK regions 292, 296 causes a display screen with various time values to be presented on display 60 (shown in FIGS. 1 and 3) for selection of a delay time or pre-soak time. Likewise, in a further embodiment, depressing or activation of WASH BOOSTER region 300 turns a wash booster feature on and off. In an exemplary embodiment, the wash booster function controls dispensation of an additive from a dispenser located in the washing machine when a wash booster additive is present in the dispenser.

Figure 10:
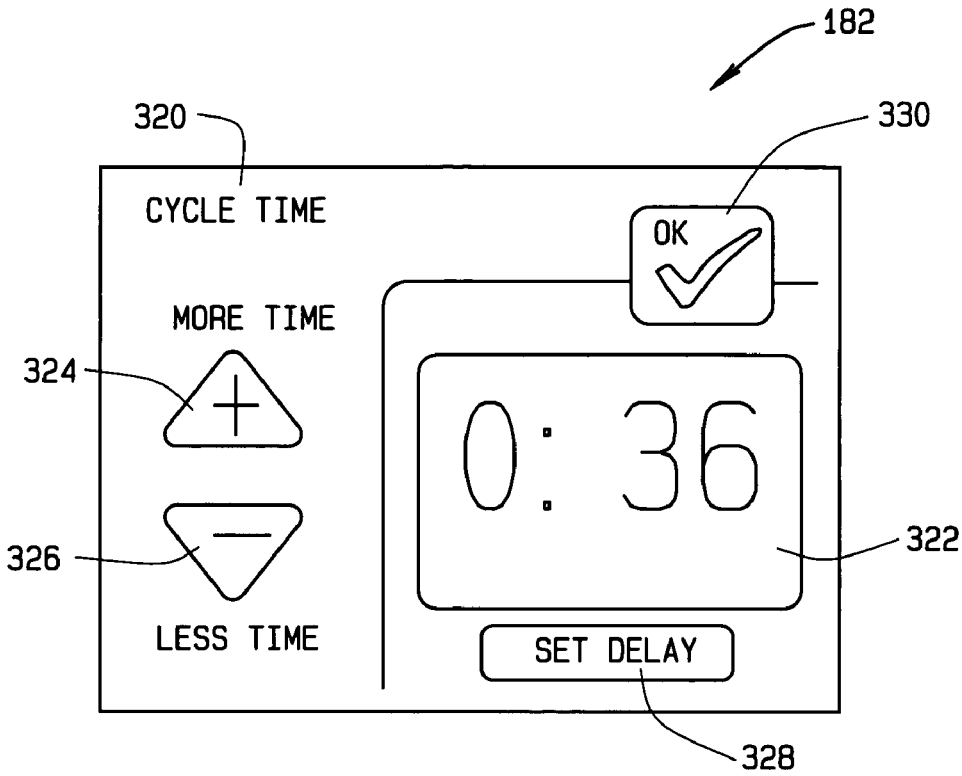
FIG. 10 is a cycle time screen display for the system shown in FIG. 4.

FIG. 10 is a CYCLE TIME screen display 182 generated by microcomputer 140 (shown in FIG. 3) in response to user activation of TIME region 252 (shown in FIG. 7) of SUMMARY SCREEN 176 (shown in FIG. 7).

CYCLE TIME screen 182 includes a title message 320 and five regions for wash cycle time selection. Specifically, and in an illustrative embodiment, the selection regions include a TIME DISPLAY region 322 that prominently displays wash cycle time in countdown timer form, a MORE TIME region 324 for increasing the wash cycle time, a LESS TIME region 326 for decreasing the wash cycle time, a SET DELAY region 328 for selecting a timed delay start of the wash cycle, and an OK region 330. Thus, when CYCLE TIME screen display 182 is presented to a user on display 60 (shown in FIGS. 1 and 3), a user may select one of regions 324-330 to select desired time options. While the illustrated embodiment of CYCLE TIME screen 182 includes five regions 324-330, it is recognized that greater or fewer regions for cycle time options could be employed in alternative embodiments without departing from the scope of the present invention. Moreover, it is contemplated that one of regions 324-330 may correspond to a second CYCLE TIME screen with additional wash time choices.

To assist in the time selection process, MORE TIME and LESS TIME regions 324, 326 are shaped in the form of up and down slew keys with plus and minus designations, respectively. OK region 330 includes a checkmark icon. Depressing one of regions 324-328 causes microcomputer 140 to adjust cycle time or delay, and when a desired cycle time is chosen, the user activates OK region 330. When OK region 330 is activated, microcomputer 140 displays SUMMARY screen 176 (shown in FIG. 7) with the selected cycle time displayed in SUMMARY screen region 252 (shown in FIG. 7).

Figure 11:
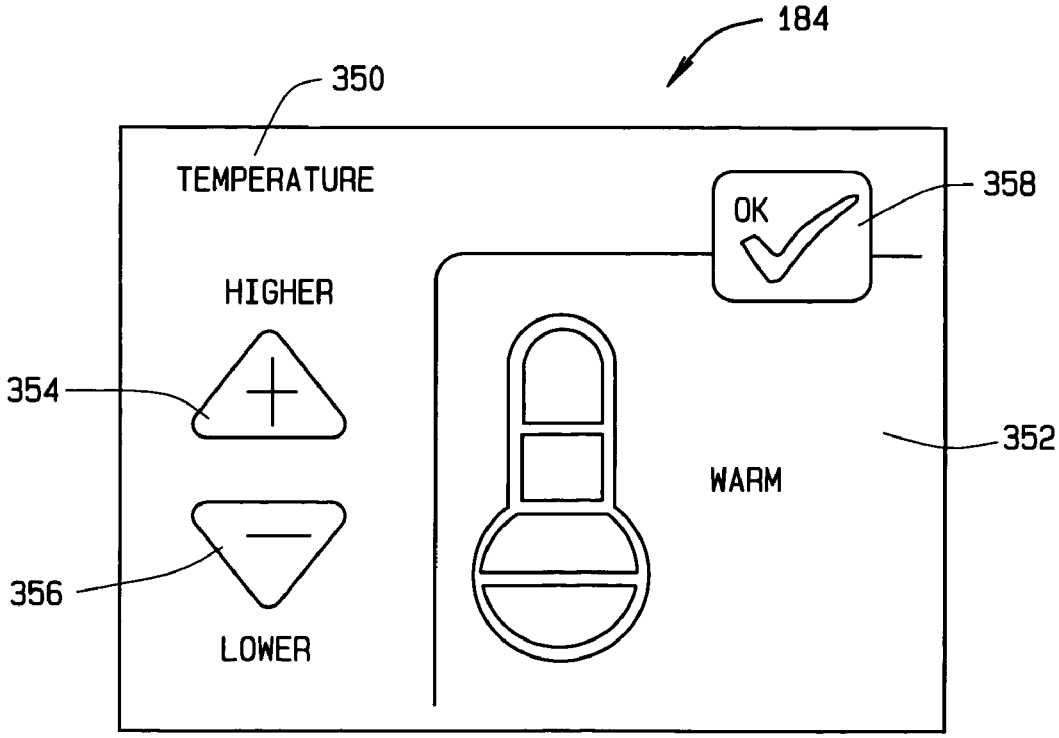
FIG. 11 is a temperature screen display for the system shown in FIG. 4.

FIG. 11 is a TEMPERATURE screen display 184 generated by microcomputer 140 (shown in FIG. 3) in response to user activation of TEMPERATURE region 246 (shown in FIG. 7) of SUMMARY SCREEN 176 (shown in FIG. 7).

TEMPERATURE screen 184 includes a title message 350 and four regions for wash cycle temperature selection. Specifically, and in an illustrative embodiment, the selection regions include a TEMPERATURE DISPLAY region 352 that prominently displays a temperature setting in graphical and textual form, a HIGHER region 354 for increasing the wash cycle temperature, a LOWER region 356 for decreasing the wash cycle temperature, and an OK region 358. Thus, when TEMPERATURE screen display 184 is presented to a user on display 60 (shown in FIGS. 1 and 3), a user may select one of regions 352-358 to select desired wash cycle options. While in the illustrated embodiment the TEMPERATURE screen 184 includes four regions 354-358, it is recognized that greater or fewer regions for cycle temperature options could be employed in alternative embodiments without departing from the scope of the present invention. Moreover, it is contemplated that one of regions 352-358 may correspond to a second TEMPERATURE screen with additional temperature selection choices.

To assist in the time selection process, HIGHER and LOWER regions 354, 356 are shaped in the form of up and down slew keys with plus and minus designations, respectively. Also, TEMPERATURE DISPLAY region 352 includes a thermometer icon having four segments therein that visibly signify the selected temperature setting, although it is contemplated that greater or fewer than four segments may be employed in alternative embodiments of the invention. As regions 354, 356 are activated to change the cycle temperature, the icon segments are changed (e.g., from light to dark) to reflect the adjusted temperature setting. Thus, cycle temperature is prominently displayed in bar graph form within the thermometer graphical icon in an intuitive manner. OK region 358 includes a checkmark icon to indicate completion of the cycle time selection.

Depressing one of regions 354, 356 causes microcomputer 140 to adjust cycle time, and when a desired cycle time is chosen, the user activates OK region 358. When OK region 358 is activated, microcomputer 140 displays SUMMARY screen 176 (shown in FIG. 7) with the temperature display icon displayed in SUMMARY screen region 246 (shown in FIG. 7).

Figure 12:
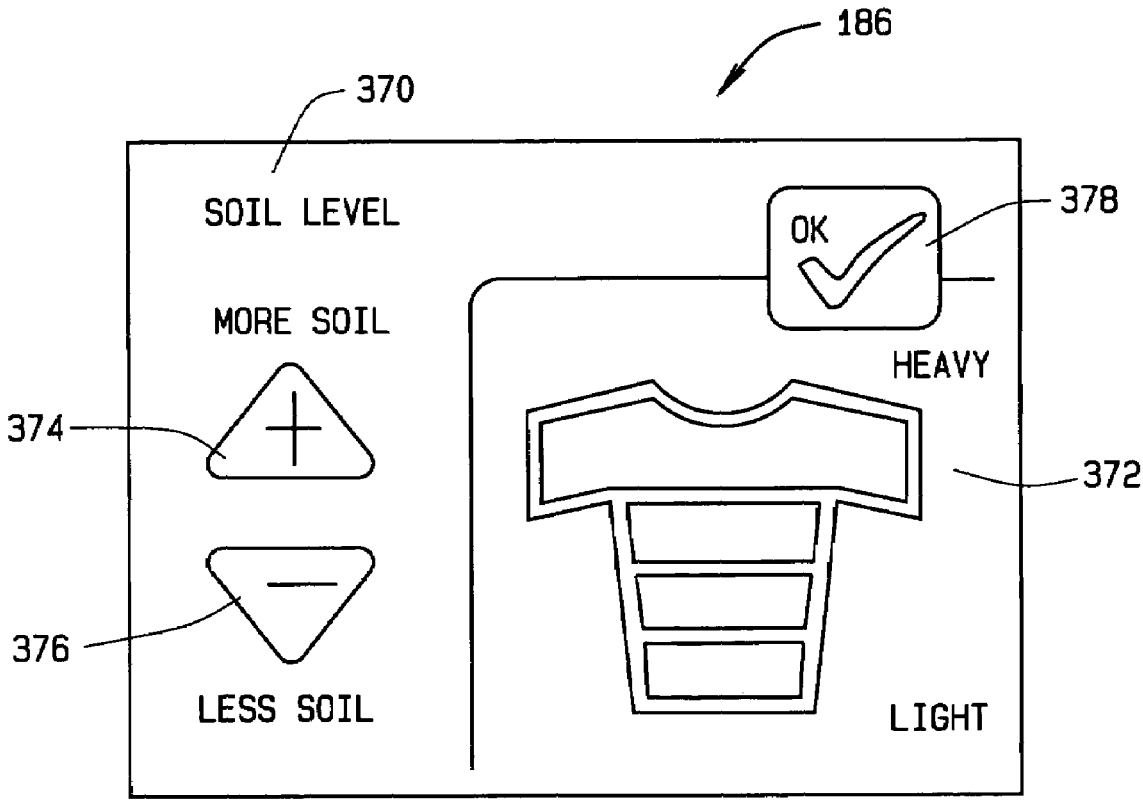
FIG. 12 is a soil level screen display for the system shown in FIG. 4.

FIG. 12 is a SOIL LEVEL screen display 186 generated by microcomputer 140 (shown in FIG. 3) in response to user activation of SOIL LEVEL region 244 (shown in FIG. 7) of SUMMARY SCREEN 176 (shown in FIG. 7).

SOIL LEVEL screen 186 includes a title message 370 and four regions for wash cycle soil level selection. Specifically, and in an illustrative embodiment, the selection regions include a SOIL LEVEL DISPLAY region 372 that prominently displays a soil level setting in graphical and textual form, a MORE SOIL region 374 for increasing the wash cycle soil level setting, a LESS SOIL region 376 for decreasing the wash cycle soil level, and an OK region 378. Thus, when SOIL LEVEL screen display 186 is presented to a user on display 60 (shown in FIGS. 1 and 3), a user may select one of regions 374-378 to select desired wash cycle options. While in the illustrated embodiment the SOIL LEVEL screen 186 includes four regions 372-378, it is recognized that greater or fewer regions for soil level settings could be employed in alternative embodiments without departing from the scope of the present invention. Moreover, it is contemplated that one of regions 372-378 may correspond to a second SOIL LEVEL screen with additional soil level choices.

To assist in the soil level setting process, MORE SOIL and LESS SOIL regions 374, 376 are shaped in the form of up and down slew keys with plus and minus designations, respectively. Also, SOIL LEVEL DISPLAY region 372 includes a T-shirt icon having four segments therein that visibly signify the selected soil level setting, although it is contemplated that greater or fewer than four segments may be employed in alternative embodiments of the invention. As regions 374, 376 are activated to change the soil level, the icon segments are changed (e.g., from light to dark) to reflect the adjusted soil level setting. Thus, the cycle soil level setting is prominently displayed in bar graph form within a graphical icon in an intuitive manner. OK region 378 includes a checkmark icon to indicate completion of the soil level selection.

Depressing one of regions 374-378 causes microcomputer 140 to adjust the soil level setting, and when a desired soil level setting is chosen, the user activates OK region 378. When OK region 378 is activated, microcomputer 140 displays SUMMARY screen 176 (shown in FIG. 7) with the soil level display icon displayed in SUMMARY screen region 244 (shown in FIG. 7).

Therefore, by using a series of graphical display screens with touch sensitive regions therein to make wash cycle selections, a large number of control inputs may be made in a simple and straightforward process with reduced cognitive effort in comparison to known washing machine control schemes having a large number of input selectors associated with available cycle options. The summary screen provides a wealth of information in a concise form during operation of the washing machine and conveniently allows user adjustment of preset cycles. Additionally, customized cycles may be saved for future use. A user friendly and convenient control scheme to accommodate a large number of wash cycle features is therefore provided.

Having now described the invention in an exemplary context of a washer machine, it is believed that those in the art could readily adapt the teaching of the above description with appropriate modification for use in another laundry appliance, such as a clothes dyer, wherein the advantages set forth above in selecting desired machine cycle features and parameters in a straightforward fashion are equally applicable. As the construction and operation of clothes dryers is well known, it is believed that the methodology of the above-described control system could be implemented in an alternative laundry appliance without further explanation.

While the invention has been described in terms of various specific embodiments, those skilled in the art will recognize that the invention can be practiced with modification within the spirit and scope of the claims.

The invention claimed is:

1. A control interface for a laundry appliance, said control interface comprising:

a microcomputer; and a reconfigurable display coupled to said microcomputer, said microcomputer programmed to present a plurality of input screens on said reconfigurable display and to display at least one graphical icon symbol and text corresponding to said at least one graphical icon symbol, said at least one graphical icon symbol representative of a laundry cycle parameter on at least one input screen of said plurality of input screens, said at least one graphical icon symbol comprising a plurality of segments representative of a level of the laundry cycle parameter, said microcomputer programmed to configure said at least one graphical icon symbol based on user input for customizing the level of the laundry cycle parameter.

2. A control interface in accordance with claim 1 wherein said at least one input screen comprises a series of input screens, said series of control input screens comprising at least one of a HOME screen, a CYCLE SELECTION screen, and a SUMMARY screen.

3. A control interface in accordance with claim 1 wherein said display is touch sensitive.

4. A control interface in accordance with claim 3 wherein said screen is divided into a plurality of touch sensitive regions, at least one of said regions including a graphical icon.

5. A control interface in accordance with claim 1 wherein said appliance is a washing machine, said HOME screen, CYCLE SECTION screen and SUMMARY screen comprising wash cycle selections.

6. A control interface in accordance with claim 1 wherein said plurality of segments further comprises a higher region indicative of a higher level of the laundry parameter and a lower region indicative of a lower level of the laundry parameter.

7. A control interface in accordance with claim 1 wherein said reconfigurable display further comprises a first region indicative of a first slew key and a second region indicative of a second slew key, said first region configured to raise the level of the laundry parameter and said second region configured to lower the level of the laundry parameter.

8. A control interface in accordance with claim 1 wherein said microcomputer is configured to store at least one customized level of the laundry cycle parameter.

9. A control interface in accordance with claim 1 wherein said microcomputer is configured to form at least one of said plurality of segments based on user input increasing the level of the laundry cycle parameter.

10. A control interface in accordance with claim 1 wherein said microcomputer is configured to remove at least one of said plurality of segments based on user input decreasing the level of the laundry cycle parameter.

11. A control interface for a laundry appliance, said control interface comprising:

a microcomputer; and a touch sensitive reconfigurable display coupled to said microcomputer, said microcomputer programmed to present a plurality of laundry cycle input screens to a user, at least one of said plurality of laundry cycle input screens comprising a graphical icon symbol and text corresponding to said graphical icon symbol, said graphical icon symbol representative of a laundry cycle parameter, said graphical icon symbol comprising a plurality of segments representative of a level of the laundry cycle parameter, said microcomputer programmed to configure said graphical icon symbol based on user input for customizing the level of the laundry cycle parameter.

12. A control interface in accordance with claim 11 wherein said plurality of input screens comprise a HOME screen, a CYCLE SELECTION screen, and a SUMMARY screen.

13. A control interface in accordance with claim 11 wherein each of said plurality of screens comprises a plurality of regions, said display touch sensitive in each of said regions.

14. A control interface in accordance with claim 11 wherein said appliance is a washing machine, said graphical icon comprises a plurality of segments representing a wash cycle setting, said microcomputer programmed to change an appearance of said segments as said wash cycle setting is adjusted.

* * * * *